United States Patent [19]

Marin

[11] 4,435,921

[45] Mar. 13, 1984

[54] SAFETY DOOR

[76] Inventor: Manuel Marin, 6777 Pie IX Blvd., Apt. 14, Montreal, Quebec, Canada, H1X 2C7

[21] Appl. No.: 365,489

[22] Filed: Apr. 5, 1982

[51] Int. Cl.[3] ..... E05C 9/00

[52] U.S. Cl. ..... 49/395; 292/33; 292/40; 292/341.17; 49/383

[58] Field of Search ..... 49/383, 395, 319, 321; 292/341.15, 341.17, 341.18, 40, 61, 300, 33

[56] References Cited

U.S. PATENT DOCUMENTS

| | | | |
|---|---|---|---|
| 266,903 | 10/1882 | Schertzer | 292/33 |
| 3,636,659 | 1/1972 | Bylicki | 49/383 |
| 3,788,679 | 1/1974 | Banham | 292/341.17 X |

FOREIGN PATENT DOCUMENTS

| | | | |
|---|---|---|---|
| 2388108 | 12/1978 | Fed. Rep. of Germany | 49/383 |
| 24280 | 8/1901 | Switzerland | 292/33 |
| 173299 | 12/1921 | United Kingdom | 292/33 |

*Primary Examiner*—Kenneth Downey

[57] ABSTRACT

There is described a safety door the lock of which, upon turning of the key, outwardly displaces the bolt which, upon engagement in the door frame, pushes out for other bolts that engage in the door. Besides, the latter has a hinge co-extensive with its height and a side provided with five dead bolts which engage in the other side of the hinge upon closing of the door. A metal plate covers each of the opposite faces of the door.

2 Claims, 6 Drawing Figures

SAFETY DOOR

FIELD OF THE INVENTION

The present invention is to securely lock a door and to make it almost impossible to succeed in breaking in. In most of the known doors, it is usual to have a lock that, upon turning the key once or twice, causes outward displacement of a bolt that locks the door.

SUMMARY OF THE INVENTION

In the present invention, the bolt itself of the door, upon outward displacement, abuts against a part and pushes outward of the frame of the door several auxiliary bolts that engage in the door. The hinge of the door preferably extends the full height of that door and one of the two plates of the hinge is provided with dead bolts that engage in the other plate of the hinge upon closing of the door. A metal plate preferably covers each of the opposite faces of the door and is concealed by a wood panel.

The advantages possessed by a door so constructed makes it almost impossible to break in and, consequently, that door is safer for our houses.

BRIEF DESCRIPTION OF THE DRAWINGS

The above will be clearer to understand by referring to the attached drawings, in which.

In the attached drawings, the same reference numerals identify the same elements.

DESCRIPTION OF THE PREFERRED EMBODIMENT

Figure 2:
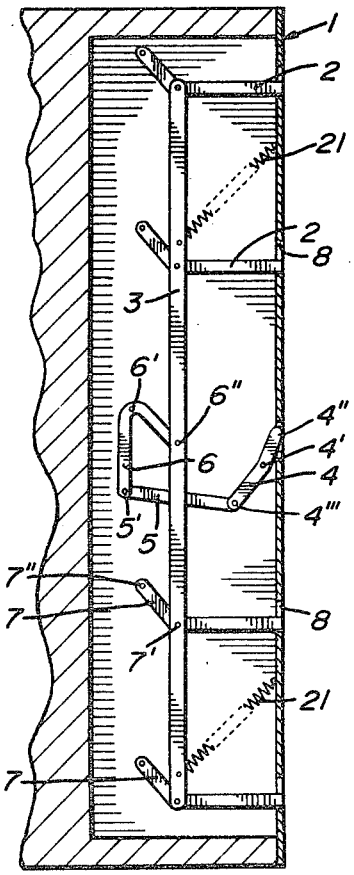
FIG. 2 is a view of the interior of the door showing the auxiliary bolt mechanism in retracted position.
Figure 3:
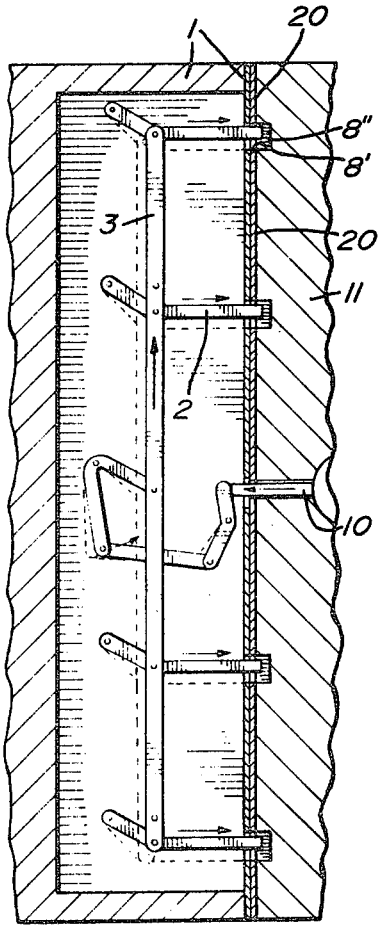
FIG. 3 is a view similar to the view of FIG. 2, but also showing the door closed and locked.

As shown in FIGS. 2 and 3, it is seen that the door frame 1 on the opposite side relative to the hinges of the door 11 includes a series of auxiliary bolts 2, which are horizontally arranged and rigidly fixed at one end to a vertical bar 3. The latter is carried by a plurality of lever arms 7 which are all of the same length, parallel to each other and inclined in upward direction away from the bolts 2. The lever arms 7 are pivoted to the bar 3 at 7' and to the door frame at 7''. Thus, the combination of the bar 3 and auxiliary bolts 2 is allowed to bodily pivot around pivot axis 7'', while remaining parallel to itself. Upon pivoting, the auxiliary bolts 2 project from the door frame through the apertures 8 of the frame 1. A lever 4 is pivoted to the frame at 4' intermediate its ends. The free upper end 4'' of the lever 4 is aligned with one of the apertures of the frame 1, which registers with the conventional bolt 10. The latter is operated by a conventional lock for the door 11, for instance installed in the door knob and key actuated. Thus, when the conventional bolt 10 projects from the free edge of the door 11, in closed position, it abuts against the free end 4'' of lever 4 and pivots the latter around the pivot axis 4'.

The free lower end of lever 4 is pivoted at 4''' to a link 5, the other end of which is pivoted at 5' to one end of a bell crank 6, the elbow portion of which is pivoted at 6' in the frame 1. The other end of the bell crank 6 is pivoted at 6'' to the vertical bar 3. Thus, when the conventional bolt 10 abuts against the upper end 4'', it produces displacement of the link 5 to the right and pivots the bell crank 6 in a counterclockwise direction to displace the bar 3 upward and outward or rightward, until the auxiliary bolts 2 project through the apertures 8 of the door frame to engage in the adjacent openings 8' and cavities 8'' in the door 11. The openings 8' are provided in a metal strip 20, fixed on the free edge of the door 11.

FIG. 3 clearly shows the conventional bolt 10 as well as the auxiliary bolts 2, all in locking position, locking the door in closed position. For greater safety, the door 11 itself is covered on each of its opposite faces with a metal plate 12, itself covered with a wood panel 13 for improved locking of the door. The door may be provided with a peep-hole 18'.

Figure 1:
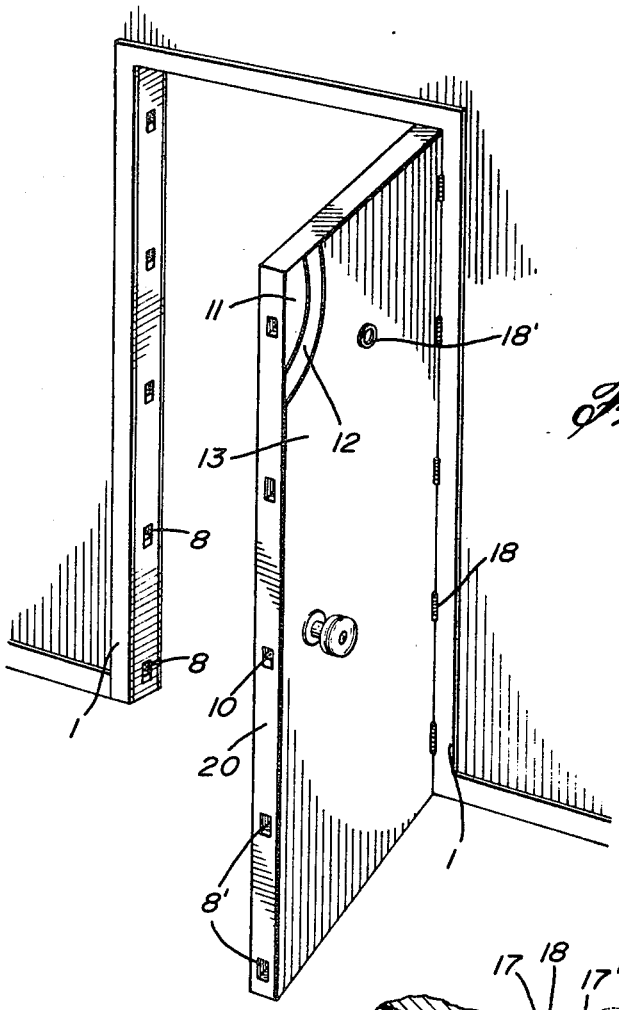
FIG. 1 is a perspective view of a door and its frame, with the door being in open position.
Figure 4:
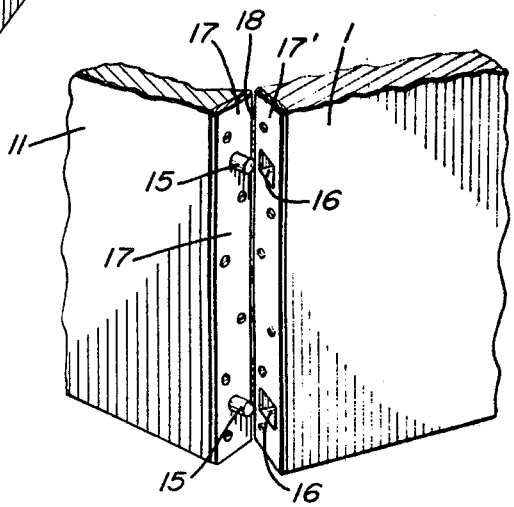
FIG. 4 is a partial perspective view of the wall and the door in partially-open position and seen from the opposite side relative to the perspective view of FIG. 1.
Figure 5:
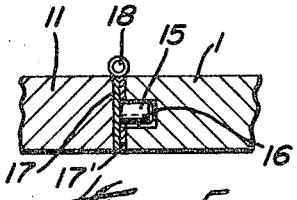
FIGS. 5 and 6 show partial cross-sectional views of the door and hinge side of the frame in positions with the door closed and opened, respectively.
Figure 6:
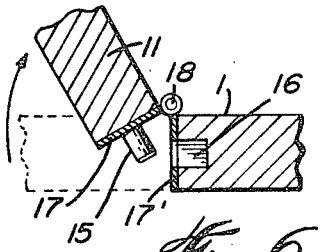

To make the door even safer, the door hinge includes hinge plates 17 and 17' extending co-extensive with the height of the door and door frame, respectively. Those hinge plates are connected by spaced-apart hinge pins 18. The hinge plate 17 is provided with several fixed bolts 15 which, upon closing the door 11, engage in the openings 6 of the hinge plate 17' and in cavities of the door frame 1, as shown in FIG. 5. Thus, after the door has been closed and locked, it cannot be removed at the hinge, even if the hinge pins 18 are pulled out.

Because bar 3 is pivotally connected to the door frame 1 by inclined lever arms 7, bar 3 and auxiliary bolts 2 fixed to the same are urged by gravity to take a withdrawn door unlocking position. Therefore, it is always possible to open the door, should one of the pivotal points 4', 4''', 7' or 7'' break under stress or wear.

In order to ease the operation of the lock which operates the bolt 10, the auxiliary bolt mechanism in the door frame is counterbalanced, for example by means of springs 21 secured at one end to the vertical bar 3, and at the other end to the door frame 1. The auxiliary bolt mechanism is housed in the door frame and in the associated wall. This alows to lighten the door 11 itself and it thus eases its handling.

What I claim is:

1. In a door and associated door frame, the door including a lock operating a bolt by use of a key, the bolt then operatively projecting from the free edge of the door and engaging in an opening of the door frame, said free edge being provided with a series of spaced-apart cavities along said edge, a lever pivoted in the door frame and operated by said bolt, and a series of auxiliary bolts installed in the door frame and operated by said lever to move from a withdrawn unlocking position to a projecting locking position, wherein their free ends project from the door frame and engage into said cavities of the door, said auxiliary bolts being substantially parallel, horizontal and fixed at their opposite ends to a generally vertical common bar located within said door frame, at least two lever arms of equal length pivotally connected to the bar and to the door frame and equally inclined in upward direction away from said auxiliary bolts, said lever pivotally connected to said common bar and, upon being pivoted by said bolt, moving said common bar from a lower position in which the auxiliary bolts are in their withdrawn position, to a higher position in which the auxiliary bolts are in their projecting position, whereby said auxiliary bolts tend to move to their withdrawn position under gravity.

2. In a door and door frame as defined in claim 1, further comprising counterweight means acting on said bar and the auxiliary bolts and constructed and arranged to ease the action of the bolt of the lock on said lever.

* * * * *